US006463604B1

(12) United States Patent
Reveron et al.

(10) Patent No.: US 6,463,604 B1
(45) Date of Patent: Oct. 15, 2002

(54) RECONFIGURED BEDDING, CONTAINER AND TRANSPORTATION APPARATUS

(75) Inventors: Terri E. Reveron, 16516 Jilrick St., Rockville, MD (US) 20853; Marlene Voecker, McLean, VA (US)

(73) Assignee: Terri E. Reveron, Rockville, MD (US)

( * ) Notice: Subject to any disclaimer, the term of this patent is extended or adjusted under 35 U.S.C. 154(b) by 0 days.

(21) Appl. No.: 09/520,016

(22) Filed: Mar. 6, 2000

Related U.S. Application Data

(60) Provisional application No. 60/125,578, filed on Mar. 22, 1999.

(51) Int. Cl.[7] ..... A47C 9/08; A47C 17/64; A47G 9/06

(52) U.S. Cl. ..... 5/413 R; 5/420

(58) Field of Search ..... 5/413 R, 413 AM, 5/420, 656, 486, 162; 190/2–18 A; 383/4

(56) References Cited

U.S. PATENT DOCUMENTS

| | | | | | |
|---|---|---|---|---|---|
| 1,315,294 | A | * | 9/1919 | Fink et al. | 5/413 R |
| 1,822,893 | A | * | 9/1931 | Kapolkin | 280/651 |
| 2,228,066 | A | * | 1/1941 | Tashbook | 280/47.17 |
| 3,268,922 | A | * | 8/1966 | Moxley | 5/420 |
| 3,831,206 | A | * | 8/1974 | Geary | 5/413 R |
| 4,601,076 | A | * | 7/1986 | Knobeloch | 5/413 R |
| 4,671,393 | A | * | 6/1987 | Rainey | 190/1 |
| 4,796,734 | A | * | 1/1989 | Distasio | 190/1 |
| 4,896,387 | A | * | 1/1990 | Malcolm et al. | 5/413 R |
| 5,005,235 | A | * | 4/1991 | Huang | 5/413 R |
| 5,010,610 | A | * | 4/1991 | Ackley | 5/420 X |
| 5,099,530 | A | * | 3/1992 | Scott | 5/420 |
| 5,113,982 | A | * | 5/1992 | Pulichino et al. | 190/18 A |
| 5,210,891 | A | * | 5/1993 | Avital et al. | 5/420 |
| 5,287,571 | A | * | 2/1994 | Rademacher | 5/413 R |
| 5,303,805 | A | * | 4/1994 | Hauser | 190/18 A |
| 5,370,460 | A | * | 12/1994 | Nelson | 383/4 |
| 5,622,300 | A | * | 4/1997 | Robinson | 224/575 |
| 5,630,602 | A | * | 5/1997 | Vanderslice et al. | 280/47.26 |
| 5,640,725 | A | * | 6/1997 | Ando et al. | 5/413 AM |
| 5,735,003 | A | * | 4/1998 | Judge | 5/413 AM |
| 5,956,767 | A | * | 9/1999 | Imm | 2/69.5 |

FOREIGN PATENT DOCUMENTS

| | | | | |
|---|---|---|---|---|
| FR | 1376523 | * | 9/1964 | 5/413 AM |
| FR | 2396490 | * | 3/1979 | 5/413 R |
| GB | 6465 | * | 12/1915 | 5/413 R |
| GB | 898653 | * | 6/1962 | 5/413 R |
| GB | 2166343 A | * | 5/1986 | 5/413 AM |
| GB | 2177292 A | * | 1/1987 | 5/420 |

* cited by examiner

*Primary Examiner*—Robert G. Santos

(57) ABSTRACT

A reconfigurable bedding, container and transportation apparatus configured to provide sleeping support for a person when in a rolled-out configuration, and serving as a transportable personal belonging enclosure when in a rolled-up configuration. At least one wheel is attached to a platform at one end of a sleeping cushion, where the wheel and platform are suitable for supporting a weight of the sleeping cushion and a tubular blanket positioned thereon when in the rolled-up configuration and when towed by a person. An interior portion of the sleeping cushion and tubular blanket containing at least one compartment configured to hold for safe keeping personal belongings of the person when either in the rolled-out configuration or the rolled-up configuration.

20 Claims, 3 Drawing Sheets

RECONFIGURED BEDDING, CONTAINER AND TRANSPORTATION APPARATUS

CROSS REFERENCE TO RELATED APPLICATION

The present document claims the benefit of the earlier filing date of U.S. Provisional Application Ser. No. 60/125,578 filed on Mar. 22, 1999, the entire contents of which being incorporated herewith by reference.

BACKGROUND OF THE INVENTION

1. Field of the Invention

The present invention is directed to that provide comfortable bedding as well as transportable containers for carrying personal items. More particularly, the present invention is directed to devices that serve multiple purposes of providing an apparatus for securely packaging and transporting one's personal items and bedding material when arranged in a compact, mobile configuration and also providing the bedding material and packaging compartments for holding the personal items while in a second, static configuration.

2. Discussion of the Background

Preparing a child for a sleepover can be a troublesome endeavor both for the parent and the child alike. The parent has the burden of not only packing the essential materials for the child, but must also attempt to minimize the number of items the child brings so the child can carry everything without too much trouble. Typical items include a sleeping bag, a pillow, a favorite toy, blanketing, toiletries, and the like. Some parents will pack a separate cushion for the child so that if the child sleeps on something other that a bed or soft carpet, the sleeping experience will not be too uncomfortable. The sleeping bag and cushion are usually rolled up in separate rolls and each held closed with a sting or tie, which serves as a handle. The child tucks the pillow and toy under an arm and the rest of the child's gear is held in a separate container, like a suitcase. If the child is too small, an adult or friend will assist the child by carrying some of the items.

As recognized by the present inventor, when arranging the sleepover items for the child, the parent may be left with the nagging concern that the child will forget where some important item, such as medicine, is placed in the several items carried by the child. Furthermore, the parent may be concerned about the child absent mindedly forgetting to bring all of the items with him or her at each stage in the journey, like when getting on a bus, leaving a car, etc. In part, the problem of recognizing where things are located, and how many things are to be carried by the child is due to the child not being engaged in the packing process and because the several items brought by the child do not have their own "designated space".

By themselves, sleeping bags generally only contain one main sleeping compartment and do not have additional pockets for carrying other items. Thus, when the child has smaller items that the child has either packed within or obtained during the sleepover, the child has no convenient closed space to place their items and feel comfortable that the items will not be lost during transportation. Furthermore, due to their small size, some children are physically incapable of carrying a sleeping bag in one arm, a suitcase in another, and all their personal belongings with any degree of convenience. For example, when opening a door to go inside, the child will have to place one of their belongings on the ground in order to free-up a hand to open the door, giving rise to the possibility that the item will become damp or wet.

Another problem with the conventional approach of packing for a sleepover is the problem of physically transporting the child's belongings for a long distance. Carrying a bulky suitcase, sleeping bag, pillow and other items can become tiring when carried for a long distance. Also, because the child's hands are preoccupied with carrying the several items, there is a risk that when the child becomes tired of carrying the items, the child may trip, but not have a free hand to stop their fall.

SUMMARY OF THE INVENTION

One object of the present invention is to overcome the above-identified deficiencies with conventional devices for packaging and transporting a sufficient amount of personal belongings and bedding materials to ensure a person's overnight stay is an enjoyable and safe one. While this is just one object of the present invention, numerous other features and attributes of the present invention will become evident from the accompanying figures and detailed description of the preferred embodiments.

The above and other objects may be accomplished with a reconfigurable bedding container and transportation apparatus. In one embodiment, a sleeping cushion is disposed under a zippered blanket so as to cushion the weight of the person when sleeping in the blanket, on top of the cushion. Both the sleeping cushion and blanket are flexible so that they may be rolled together, where the bottom portion of the cushion faces outward so as to keep the blanket clean. A "foot end" of the cushion is attached to a support board that may either lay on the ground or remain perpendicular to the ground when in the rolled-out configuration. Wheels are attached with foldable brackets, for example, to a side of the support board that is opposite to the side on which the sleeping cushion is attached. The support board helps to anchor the support cushion when in the rolled-out position, and serves as a wheeled base when in a rolled-up configuration. The foot-end of the zippered blanket need not be permanently attached to foot-end of the sleeping cushion so as to permit the person sleeping in the blanket to have the blanket turn with the person when turning over in their sleep.

When reconfigured to the rolled-up configuration, i.e., the transportable configuration, the sleeping cushion is successively rolled over top of the blanket in a continuous fashion until the joint roll configuration of the sleeping cushion and the blanket roll up to, at terminate at the support board. Once rolled, flexible straps, which were positioned underneath the sleeping cushion when in the rolled out configuration, may be wrapped around the outer periphery of the joint roll and board and detachably attached to themselves and/or to the support board so as to keep the joint roll closed. An adjustable handle connects the two straps and is generally oriented on an opposite side of the joint roll from the wheels on the support board. Accordingly, most of the weight of the composite structure is supported by the wheels such that a person, like a child, can easily tow the structure with one hand, leaving one hand for opening a door or for breaking a fall.

Another feature of the present invention is the incorporation of collapsible wheel brackets, that fold under the support board if it desired to place the support board flat on the ground, in the rolled-out configuration, perhaps avoiding injury or to extend the useful length of the blanket and sleeping cushion.

The present invention incorporates numerous other features, such as a closable pocket formed on the top of the blanket, suitable for safely keeping personal items. The closable pocket may include partitions, such that one of the partitions can be reserved for "important" items, like medication or notes from a parent or medical doctor.

Another feature of the present invention is to include a flap on top of the blanket of sufficient size to host a pillow and perhaps another other item, like a favorite toy underneath thereof. The flap holds the pillow, as well as other items, either in the rolled-out configuration or in the rolled-up configuration.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
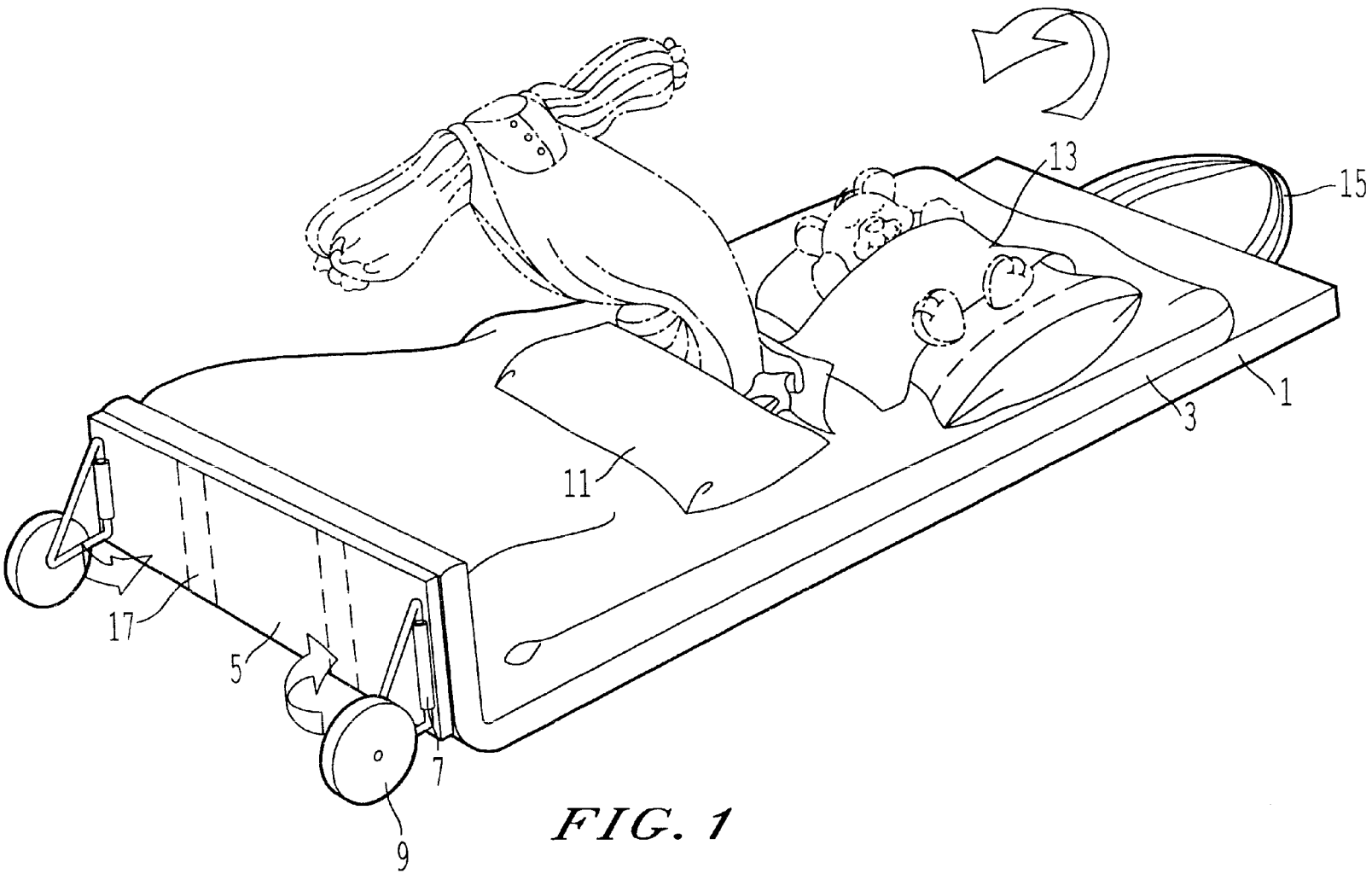
FIG. 1 is a profile view of a reconfigurable bedding container and transportation apparatus configured in a rolled-out position, according to the present invention.

Referring now to the drawings, wherein like reference numerals designate identical or corresponding parts throughout the several views, and more particularly to FIG. 1, FIG. 1 shows a first embodiment of with a reconfigurable bedding container and transportation apparatus in an extended, rolled-out position. A sleeping cushion 1 is shown to be detachably attached, or alternatively permanently affixed, to a platform 5 as shown. The sleeping cushion 1 is a stiff, but rollable, foam pad or other recognized equivalent for cushioning a person's back while sleeping on the ground. The platform 5 is a plastic board, although even a stiff foam board or other support structure, such as a metal or wood plate may be used as well. The sleeping cushion 1 is of a suitable length according to the size of the person who will sleep in a tubular blanket 3 disposed thereon. Detachably attached, or permanently affixed to the sleeping cushion 1 is the tubular blanket 3, which in the preferred embodiment contains a zipper along a side and bottom edge thereof, not unlike a sleeping bag. Alternatively, either a VELCRO closure, no closure at all, a snapped closure, or folds of cloth are alternative configurations. Furthermore, the tubular blanket 3, or a sleeping bag, may be used without the sleeping cushion 1, and in this configuration the tubular blanket 3 or sleeping bag is detachably attached or permanently affixed to the platform 5.

While in the present embodiment the blanket 3 is detachably attached to the sleeping cushion 1, it is also possible for the blanket 3 to be permanently affixed to the sleeping cushion 1. By detachably attaching the tubular blanket 3 to the sleeping cushion 1, it is possible to wash the blanket 3 separate from the sleeping cushion 1 and platform 5. Alternatively, when the blanket 3 is permanently affixed to the sleeping cushion 1, the sleeping cushion 1 may be made out of a material that is also suitable for washing. Likewise the platform 5 may be made of a material that is suitable for washing as well, although it is preferred to have the wheels 9 and bracket 7 detached from the platform 5 when washed.

On a top surface of the blanket 3 is a closable pocket 11 that is closed with a flap that covers the opening of the pocket 11 so as to safely keep the personal belongings of the person using the device. For example, the pocket 11 is of suitable size to contain a change of clothes, pajamas, personal items, toiletries, medication and the like. In an alternative embodiment, the pocket 11 contains separate subcompartments that isolate dirty clothing from clean clothing and personal belongings. Similarly, the pocket 11 may be fully lined or partially lined with a protective liner such as plastic, to avoid spillage. In this case, the pocket 11 is suitable for use in transporting snacks, canned or bottled beverages and equivalents. The flap is secured and/or sealed, over the opening of the pocket 11 by way of VELCRO, snaps, a zipper, sealing mechanism or the like. The material used to make the pocket should not be too heavy and uncomfortable for the person sleeping in the tubular blanket 3.

In one embodiment, a flap 13 made of a loop of fabric or expandable plastic product is attached at both ends to the top of the blanket 3, as shown. The flap 13 may be placed on either side of the pocket 11. The flap 13 is of a suitable size to have a pillow fit underneath the flap 13. While the flap may be of a custom size for accommodating standard, or custom, sized pillows, an expandable material may be used for the flap 13 to keep items other than the pillow under the flap 13. For example, a child may tuck a teddy bear under the flap 13 along with a pillow. Alternatively, the flap may be replaced with or augmented with an inflatable (or permanent) pillow, also affixed to the tubular blanket 3. The inflatable pillow may also be detachably attached to the tubular blanket 3.

A pair of fabric straps 15 extend under the sleeping cushion 1 while the apparatus is in the rolled-out configuration. These straps are later used to bind an outer periphery of the apparatus when in a rolled-up configuration. VELCRO strips, or buckets are included on the straps so that when wrapped around the joint roll, the straps may be secured to themselves.

On opposite ends of platform 5, foldable mounting brackets 7 serve as supports for the wheels 9 as shown. Casters, a single elongated cylinder or a strip of bearings may also be used, for example, in place of the wheels 9. The brackets 7 are hinged so as to allow the brackets 7 and wheels 9 to be folded against the bottom surface of the platform 5 so that the platform 5 may lay flush with the ground. While two wheels are shown, an additional third wheel or more wheels may be used as well. Alternatively, one larger wheel, such as rolling-pin type wheel may be used as an alternative. The wheels 9 and bracket 7 may be replaced with a single axle-type wheeled configuration that provides a rolling mechanism for supporting the apparatus when in a rolled-up configuration.

As an alternative, the brackets 7 or self bracketing wheels may be detachably attached to the platform by way of a catching mechanism, such as a mechanical catch, to hold the wheels in place. When the wheels are removed, the device may be worn as a backpack, with the wheels stored in the backpack. The platform is optionally detachable. As a further alternative, the wheels may be detachably attached to the tubular blanket 3 by way of plastic strips that are affixed (permanently, or removably) to the tubular bag 3. The colors of the wheels themselves, as well as the brackets may be made of assorted colors.

Figure 2:
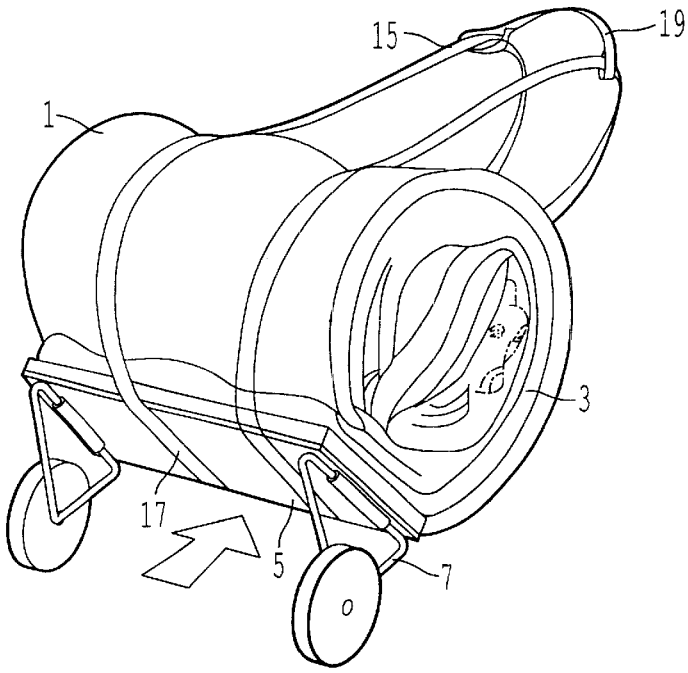
FIG. 2 is a profile view of with a reconfigurable bedding container and transportation apparatus when in a rolled-up configuration.

FIG. 2 shows the reconfigurable bedding container and transportation apparatus in a rolled-up, transportable condition. As seen, the brackets 7 and wheels 9 cooperate with the platform 5 to provide a rollable base on which the person may tow the apparatus and belongings contained therein. As seen in FIG. 2, the materials placed in the pocket 11, as well as underneath the flap 13, are securely captured and held within a center of the joint roll of the sleeping cushion 1 and blanket 3. In this way, the sleeping cushion 3 safely keeps the personal belongings of the person in tact and also protects the belongings from moisture and dirt. When rolled-up as shown in FIG. 2, the straps 15 extend around an outermost periphery of the sleeping cushion 3 and the platform 5 as shown. One type of fastener is VELCRO, although other fasteners such as snaps, adhesives and the like may be used as well to make the straps 15 self-anchored, detachably attached, or permanently affixed to the platform 5. An adjustable handle 19 interconnects the two straps 15 and serves to provide a single, balanced location from which a person can tow the rolled-up apparatus with a single hand in a safe and convenient fashion.

The platform 5, sleeping cushion 1, tubular blanket 3, straps 15 as well as the other components shown in FIGS. 1 and 2 may be made in various colors, such as bright/neon colors. The straps themselves may be made of a webbed material, or the like.

Figure 3:
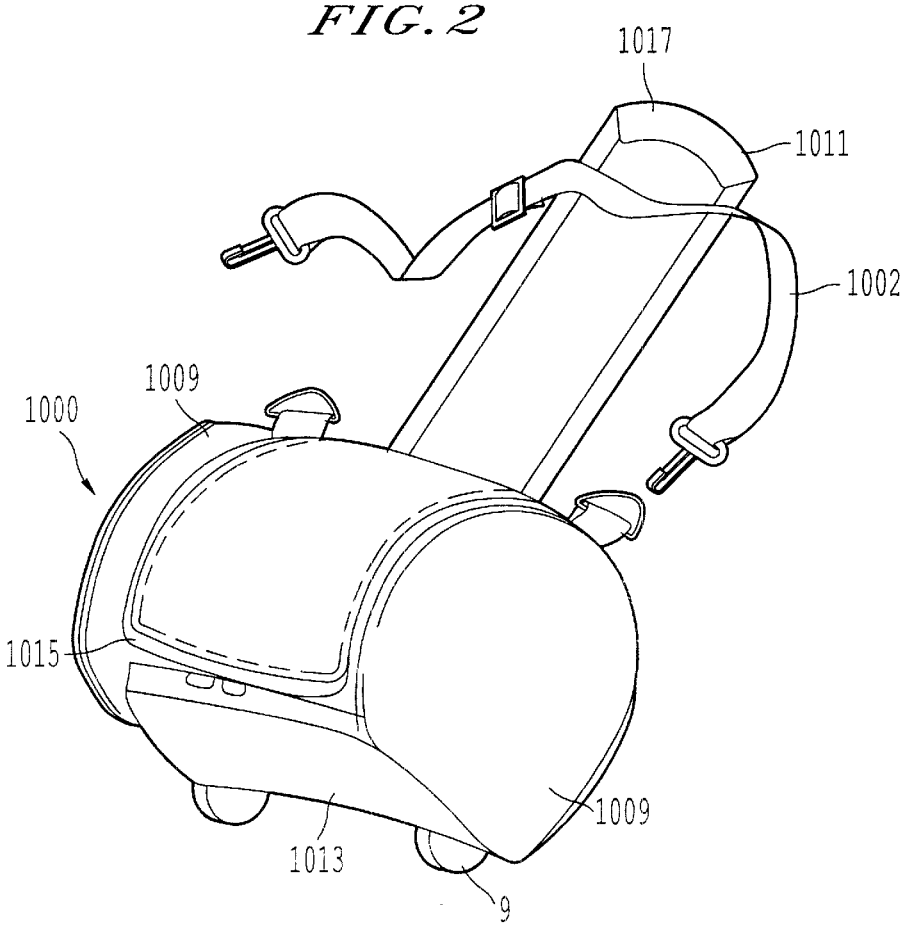
FIG. 3 is a profile view of a duffle bag embodiment of the present invention when in a rolled-up configuration.

FIG. 3 shows a duffle bag 1000 according to the present invention. The duffle bag 1000 includes wheels 9 incorporated into a platform 1013. The duffle bag 1000 includes side pockets 1009 and a front full double zipper 1015, which when opened enables the sleeping bag and an adjustable strap 1002 to be pulled out. The adjustable strap 1002 connects to hooking mechanisms attached to the duffle bag 1000 as shown in FIG. 3. The duffle bag 1000 includes a retractable handle 1017 that may include an electronics portion 1011. The electronics portion 1011 may be adapted to hold a light in an upper part or a lower part of the retractable handle 1017 so as to see where one is going when towing the duffle bag 1000. The electronics portion 1011 may optionally include a radio and/or a digital clock.

The platform 1013 may be made of a metal (such as aluminum) to which the sleeping bag is attachable on one side thereof. The wheels 9 are not solely supported on a same side of the platform as the sleeping bag, such that when the sleeping bag is in a rolled-up configuration the wheels may contact the ground so the duffle bag embodiment can be towed.

Figure 4:
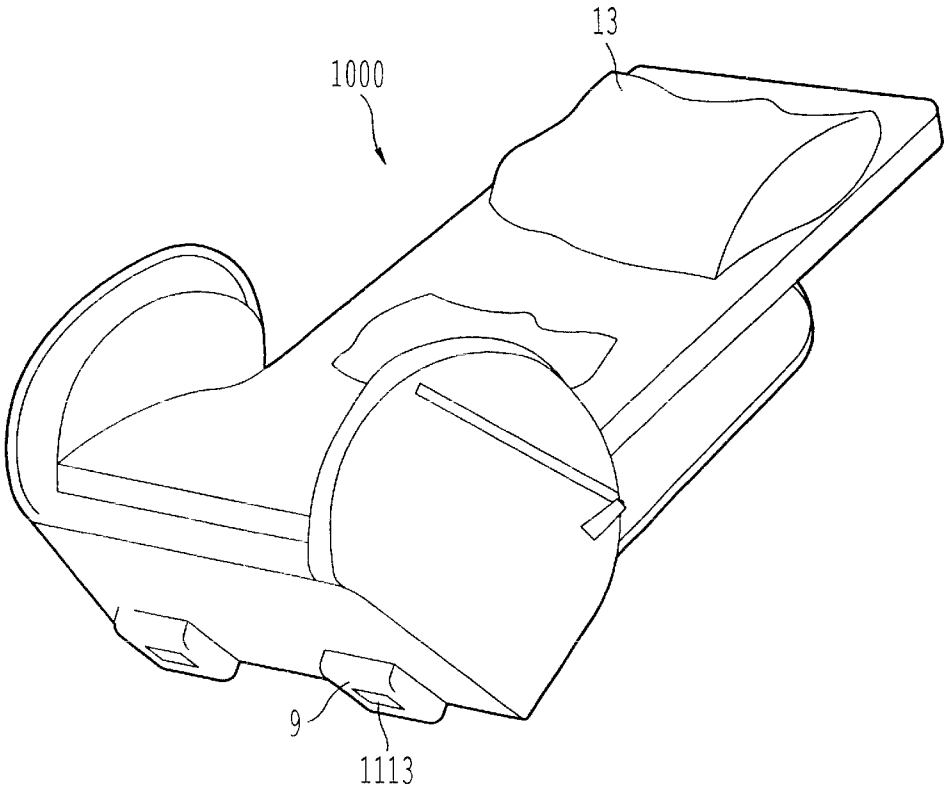
FIG. 4 is a profile view of the duffle bag embodiment when in a rolled-out configuration.

FIG. 4 shows the duffle bag 1000 when in a rolled out configuration. The pillow flap 13 and pocket 11 are shown, consistent with that shown in FIG. 1. Furthermore, incorporated into wheel 9 is a computer chip 1113 that is used in making audible noises (sounds) which coincide with the ornamental design of the sleeping bag. For example, the sound could be that of a racing car, characters etc.

Figure 5:
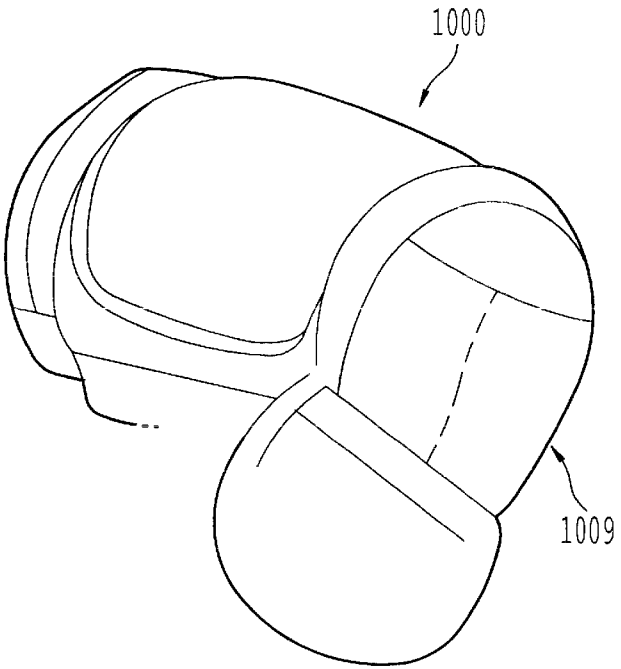
FIG. 5 is a profile view of the duffle bag embodiment with a side pocket opened.

FIG. 5 is a profile view of the duffle bag 1000, that shows the side pocket 1009 (see, e.g., FIG. 3 as well) when in an open configuration. Furthermore, the retractable handle 1017 is in a retracted position and thus not visible.

Obviously, numerous variations of the present invention are possible in light of the above disclosed embodiments and the claims appended hereto should be construed in this light. Accordingly, the present invention is considered to encompass all technical and industry recognizable equivalents to the specific structures and materials disclosed herein.

What is claimed is:

1. A reconfigurable bedding, container and transportation apparatus, comprising:

a sleeping cushion having opposed top and bottom surfaces and configured to support a weight of a person when laying prone thereon when said sleeping cushion is in a rolled-out configuration;

a tubular blanket having a cavity therein configured to host the person therein when said sleeping cushion is in said rolled-out configuration, said tubular blanket being disposed on said top surface of said sleeping cushion when in said rolled-out configuration, and said sleeping cushion being wrapped around said tubular blanket when in a rolled-up configuration;

a platform having a first surface in contact with said bottom surface of said sleeping cushion; and a wheel configured to be connected to another surface of said platform, wherein when in the rolled-up configuration, said wheel being positioned to contact and roll on ground when towed and configured to support at least a portion of a composite weight of said sleeping cushion and said tubular blanket.

2. The apparatus of claim 1, further comprising:

a flexible member having a length being at least equivalent to a circumferential length of an outer surface of said sleeping cushion when in said rolled-up configuration, wherein said flexible member being configured as a handle when towing said apparatus.

3. The apparatus of claim 1, further comprising:

a closable pocket formed on top of said tubular blanket when in the rolled-out configuration.

4. The apparatus of claim 3, wherein:

said closable pocket includes separate compartments.

5. The apparatus of claim 1, further comprising:

a pillow flap attached at a top end and a bottom end of an upper surface of said tubular blanket and configured to hold a pillow against said upper surface of said tubular blanket.

6. The apparatus of claim 2, further comprising:

an adjustable handle connected to said flexible member and oriented in a generally parallel direction to a longest side of said platform.

7. The apparatus of claim 2, further comprising:

a foldable mounting bracket collapsibly attached to said platform and configured to connect said wheel to said platform.

8. The apparatus of claim 2, further comprising:

a foldable mounting bracket detachably attached to said platform and configured to connect said wheel to said platform.

9. The apparatus of claim 8, further comprising:

a catch configured to hold said wheel in at least one of a collapsed position and a deployed position.

10. The apparatus of claim 8, wherein:

when said mounting bracket is detached from said platform and when said sleeping cushion is in said rolled-up configuration said flexible member having sufficient slack to serve as backpack straps.

11. The apparatus of claim 2, wherein:

said platform comprising an aluminum material.

12. The apparatus of claim 1, further comprising:

a handle configured to hold at least one of a light, a radio and a clock.

13. The apparatus of claim 2, further comprising:

a sound making mechanism configured to generate a predetermined sound when said wheel is rolled.

14. The apparatus of claim 13, wherein:

at least one of said platform, said sleeping cushion, and said tubular blanket including an ornamental design; and said predetermined sound being associated with said ornamental design.

15. The apparatus of claim 14, wherein:

said predetermined sound is of a motor vehicle.

16. The apparatus of claim 1, further comprising:

a zipper having a length at least equivalent to a circumferential length of an outer surface of said sleeping cushion when in said rolled-up configuration, and configured to close said sleeping cushion and said tubular blanket in a duffle bag enclosure;

at least one side pocket; and a strap configured to connect to said duffle bag enclosure.

17. The apparatus of claim 16, further comprising:

a retractable handle.

18. The apparatus of claim 1, wherein:

said sleeping cushion and said tubular blanket forming a sleeping bag.

19. The apparatus of claim 17, further comprising:

at least one of a light, a radio and a clock attached to said retractable handle.

20. The apparatus of claim 16, further comprising:

a sound making mechanism configured to generate a predetermined sound when said wheel is rolled.

* * * * *